US005467679A

United States Patent [19]

Schmidt

[11] Patent Number: 5,467,679

[45] Date of Patent: Nov. 21, 1995

[54] DISCRETE STRING DAMPER FOR A GUITAR

[76] Inventor: Bradley R. Schmidt, 977 River Rd., Windom, Minn. 56101

[21] Appl. No.: 429,789

[22] Filed: Apr. 27, 1995

[51] Int. Cl.[6] ..... G10D 3/14

[52] U.S. Cl. ..... 84/312 R

[58] Field of Search ..... 84/267, 312 R, 84/314 N, 318, 453

[56] References Cited

U.S. PATENT DOCUMENTS

| | | | |
|---|---|---|---|
| 4,753,147 | 6/1988 | Berardi | 84/453 |
| 5,284,077 | 2/1994 | Ellis | 84/318 |

OTHER PUBLICATIONS

Melted Rainbow Music Sales Brochure, Published 1993, Harrisburg, Pa. 17112–0732.

Kleen–Axe Advertisement, Published More Than 1 Year Prior to Subject Patent Appl Filing Date, Garden Grove, Calif.

*Primary Examiner*—Patrick J. Stanzione

*Attorney, Agent, or Firm*—Robert J. Harter

[57] ABSTRACT

A guitar string damper device includes six discrete damper arms for selectively dampening each string individually. The device universally fits most guitars because it attaches to a standard guitar nut. Employing a staggered arrangement for the damper arms and levers allows a musician to quickly dampen and release individual strings while still playing.

19 Claims, 2 Drawing Sheets

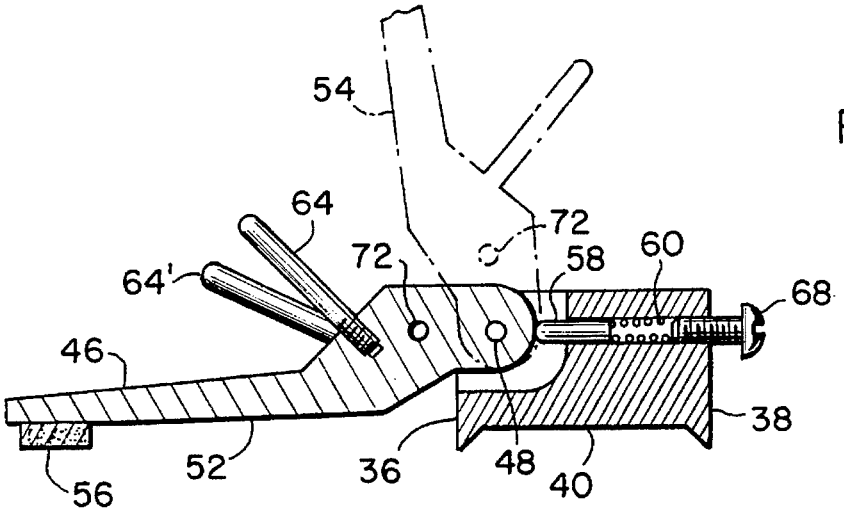
FIG. 5
FIG. 6
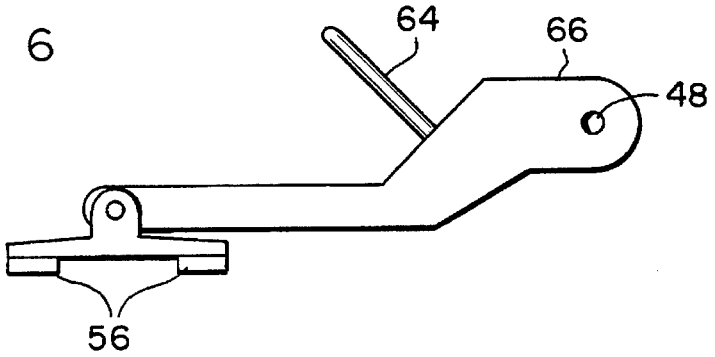
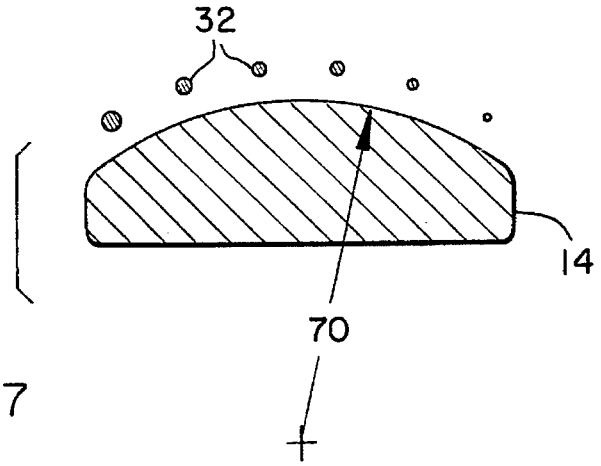
FIG. 7

DISCRETE STRING DAMPER FOR A GUITAR

BACKGROUND OF THE INVENTION

1. Field Of The Invention

The subject invention generally pertains to guitars and more specifically to a string damper for a guitar.

2. Description Of Related Art

In playing a guitar, undesirable vibration in one string can be induced into an adjacent string. This problem is often most noticeable with electric guitars.

To overcome this problem string dampers have been devised that dampen or release all strings at the same time. However, selective dampening of some strings while releasing others is preferred. In addition, today's string dampers are screwed directly onto the guitar which leave unsightly screw holes when the damper is removed. Another problem is that today's dampers obstruct one of the finger positions which makes it difficult, if not impossible, to play that position.

To advance the art of string dampers it is an object of the invention to selectively dampen each string individually.

Another object is to provide a string damper that is readily removable without tools.

Another object is to provide a string damper that includes a receptacle that readily engages standard string nuts.

Another object is to provide a string damper that, when in the dampened position, still allows a musician to play all of the finger positions.

Another object is to provide a string damper that accommodates various string diameters and fret radii.

These and other objects of the invention are provided by a novel string damper that includes six discrete dampers that are pivotally coupled to a guitar's string nut.

BRIEF DESCRIPTION OF THE DRAWINGS

FIG. 5 is a partial cross-sectional view of FIG. 4

FIG. 6 is a side view of a damper with two pads.

FIG. 7 is a cross-sectional end view of a conventional guitar neck.

DESCRIPTION OF THE PREFERRED EMBODIMENT

Figure 2:
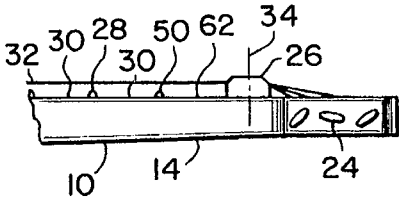
FIG. 2 is a cross-sectional view of FIG. 1.
Figure 1:
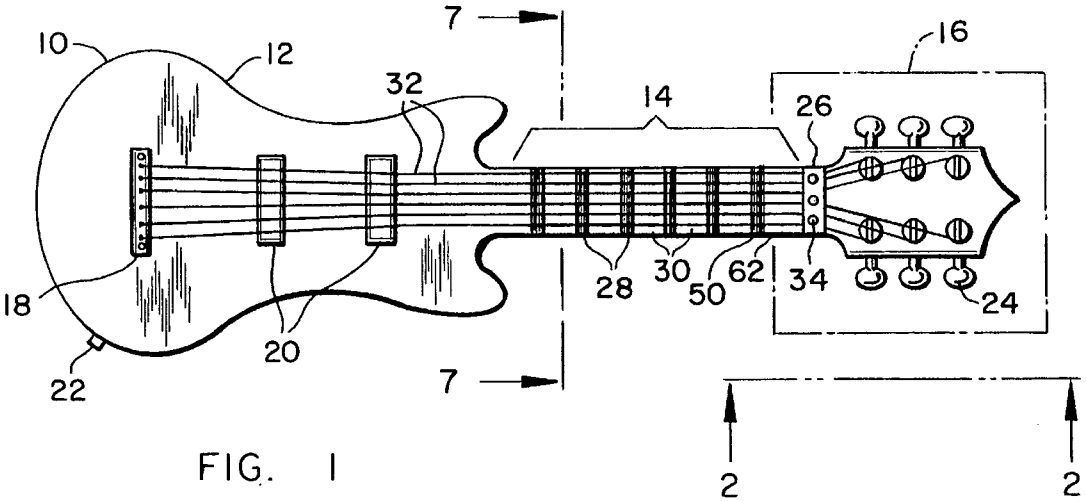
FIG. 1 is a plan view of a guitar.

A conventional electric guitar 10 of FIGS. 1 and 2 includes a body 12, a neck 14, and a headstock 16. Body 12 includes a bridge 18 and two magnetic pick-ups 20 electrically coupled to an output jack 22. Headstock 16 includes tuning pegs 24 and a nut 26. Neck 14 includes several frets 28 which define several finger positions 30 therebetween. Six wires or cables referred to herein and below as strings 32 have one end attached to bridge 18 and an opposite end attached to tuning pegs 24. Strings 32 extend over magnetic pickups 20, frets 28 and finger positions 30. Strings 32 pass through nut 26 where they are clamped in place by screws 34. Once the desired string tension is obtained via tuning pegs 24, the effective length of strings 32 can be varied by placing one's finger over selected finger positions 30 to force selected strings 32 against adjacent frets 28. Magnetic pickups 20 sense and convert string vibration to electrical signals that are conveyed through output jack 22 which in turn is typically coupled to an amplifier.

Figure 3:
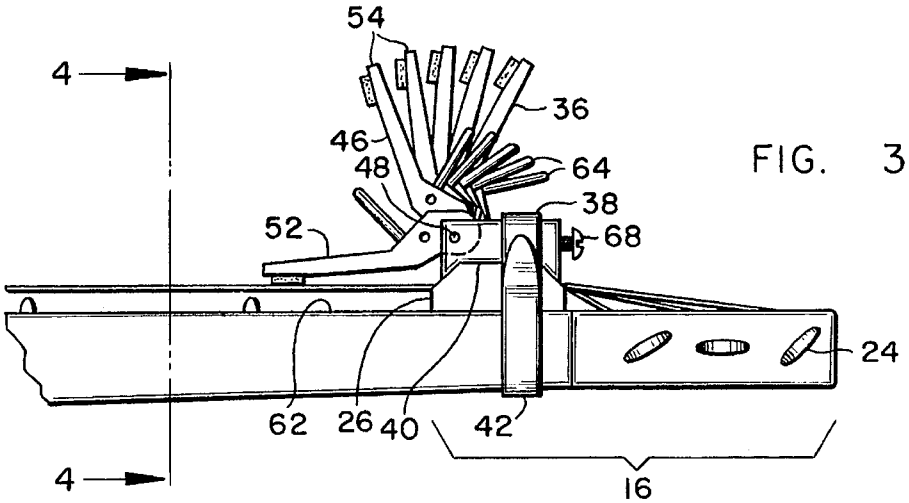
FIG. 3 is a side view of a guitar with the subject invention mounted to it.
Figure 4:
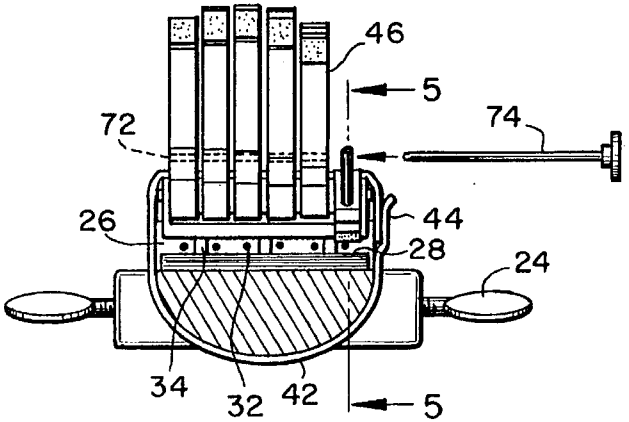
FIG. 4 is a cross-sectional view of FIG. 3, plus a locking pin.

At times vibration in one string induces undesirable vibration in adjacent strings. To overcome this problem a damper device 36 is attached to headstock 16 as shown in FIGS. 3 and 4.

Damper device 36 includes a base 38 having a receptacle 40 that fits over and engages nut 26. Base 38 is forced against nut 26 and is held in place by a strap 42 that wraps around a portion of guitar 10. Strap 42 represents any type of strap such as, for example, a conventional nylon tie-wrap commonly used in the electrical trade as a wire harness. In one embodiment of the invention, strap 42 is locked in place by a hook and loop fastener 44 such as VELCRO which a registered trademark of Velcro USA, Inc. of Manchester, N.H.

Six dampers 46 are pivotally connected to base 38 at a pivot point 48 that is situated between a first fret 50 and tuning pegs 24. The term "first fret" is defined as the playable fret that is furthest from body 12. A "playable fret" is any fret that is spaced apart from strings 32 when guitar 10 is at rest. Each damper 46 is independently repositionable to two positions of equilibrium, i.e., a closed position 52 and an open position 54 as shown in FIGS. 3, 4, and 5.

In closed position 52, a vibration dampening pad 56 on the underside of damper 46 rests against string 32. Pad 56 represents any article that dampens vibration. In one embodiment of the invention, pad 56 is made of felt, and in another embodiment, it is made of conventional magnetic material. Damper 46 is held against string 32 by a force exerted by a pin 58 and a compression spring 60. The force is sufficient to dampen vibration in string 32 without forcing string 32 against first fret 50. This allows a musician to still selectively play the first finger position 62 with dampers 46 in closed position 52. This is because a musician can still place their finger over damper 46 to force string 32 against first fret 50.

The best dampening results, when the dampening force is less than $(3)\times(\text{Dia})^5$ where the dampening force (in pounds) that a damper 46 applies to its corresponding string 32, and where "Dia" is the diameter of the string (in inches) and "0.5" is the exponential power to which "Dia" is raised. For example, ideal dampening for a 0.017 inch diameter string occurs at a dampening force of less than 0.391 pounds.

Since the ideal dampening force is a function of the string diameter, in one embodiment of the invention, the dampening force varies from one damper 46 to another on the same damper device 36. The dampening forces are adjustable by way of screws 68.

Pin 58 and spring 60 is also used to hold a damper 46 in an open position 54 where damper 46 doesn't touch its corresponding string 32. Each damper 46 includes a lever 64 to aid in lifting a damper 46 to its open position 54. In one embodiment of the invention, levers 64 are of different lengths and are staggered out of alignment to help in quickly picking out the chosen damper 46 to be lifted while playing. "Staggered out of alignment" as used herein means levers 64 are not aligned one behind the other in the closed position as viewed from the side as shown in FIG. 5. For example lever 64' of damper 46 is not hidden directly behind lever 64 of another damper.

Also, in a preferred embodiment of the invention, dampers 46 are in a staggered arrangement when in the open position. This means that some of the dampers travel a greater distance than others when moving from open position 54 to closed position 52.

Variations well within the scope of the invention include a damper device with more or less than six dampers. Base 38 of damper device 36 can be an integral part of nut 26. In one embodiment of the invention, two pads 56 are attached to a single damper 66, as shown in FIG. 6. And the invention could be used on guitars with more or less than six strings. Instead of an electric guitar, the damper device can be used on a round sound hole or flat top guitar. Also, VELCRO is only a preferred method of attaching the base of the damper device on the guitar and any number of other means could be used, including glue, screws or a mechanical clamp. It should also be noted that although nut 26 may appear to be at a transitional location between the neck and headstock of a guitar, for purpose of clarity, the headstock is defined as the part of a guitar that anchors strings 32 near the end of the guitar that is furthest from body 12 and beyond first fret 50 as shown in FIG. 1.

Although FIG. 4 shows strings 32 disposed along a common plane, damper device 36 works equally well when strings 32 are disposed along an imaginary curved surface as depicted in FIG. 7. This curved surface generally follows the fret board radius 70 which typically can vary from 7 to 16 inches as well as being flat with no radius at all.

Referring to FIG. 5, a lock, consisting of holes 72 working in conjunction with pin 74 (FIG. 4), optionally interlocks dampers 46 so that they move as one unit.

Although the invention is described with respect to a preferred embodiment, modifications thereto will be apparent to those skilled in the art. Therefore, the scope of the invention is to be determined by reference to the claims which follow:

I claim:

1. A damper device for use on a guitar having a body coupled to a headstock by way of a neck, said guitar having six strings extending from said body, along said neck and attached to said headstock, said damper device comprising:

a base adapted for attachment to said headstock; and six dampers corresponding to said six strings, said six dampers being pivotally connected to said base, each of said six dampers having two positions of equilibrium including a closed position and an open position, each of said six dampers being independently repositionable to said closed position and said open position, wherein said closed position and said open position respectively correspond to engagement and disengagement of one of said six dampers with one of said six strings.

2. The damper device of claim 1, wherein said base is adapted to engage a nut attached to said headstock.

3. The damper device of claim 2, wherein said base is attachable to said nut by way of a strap.

4. The damper device of claim 3, wherein said strap includes a hook and a loop fastener.

5. The damper device of claim 1, wherein said six dampers are in a staggered arrangement when in said open position whereby some of said six dampers travel a greater distance than other of said six dampers when moving from said open position to said closed position.

6. The damper device of claim 1, further comprising six levers corresponding and attached to said six dampers.

7. The damper device of claim 6 wherein said six levers are staggered out of alignment with each other when all of said six dampers are in said closed position.

8. The damper device of claim 1, wherein said six dampers includes a first damper and a second damper, and said six strings includes a first string and a second string, wherein said first damper applies a first dampening force against said first string that is appreciably greater than a second dampening force applied by second damper against said second string when said first damper and said second damper are in said closed position.

9. The damper device of claim 1, further comprising two vibration dampening pads disposed on one of said six dampers.

10. The damper device of claim 1, further comprising a magnetic vibration dampening pad disposed on one of said six dampers.

11. The damper device of claim 1, further comprising a lock interconnecting said six dampers so that said six dampers move in unison.

12. The damper device of claim 11, wherein said lock includes a locking pin passing through each of said six dampers.

13. A guitar, comprising:

a body;

a headstock;

a nut attached to said headstock;

six tuning pegs attached to said headstock;

a neck with one end attached to said body and an opposite end attached to said headstock;

a plurality of frets on said neck for dividing said neck into a plurality of finger positions with a first finger position being adjacent a first fret and disposed on said headstock;

a bridge on said body;

six strings attached to said bridge, extending along said neck, over and spaced apart from said plurality of frets, across said nut, and attached to said six tuning pegs;

a damper device having a base coupled to said headstock; and six dampers corresponding to said six strings, said six dampers being pivotally connected to said base about a pivot point situated between said first fret and said tuning pegs, each of said six dampers being independently repositionable between a closed position and an open position, said closed position representing one of said six dampers engaging one of said six strings at a location over said first finger position with a force light enough to keep said one of said six strings spaced apart from said first fret, said open position representing said one of said six dampers disengaged from all of said six strings.

14. The guitar of claim 13, wherein said base engages said nut.

15. The guitar of claim 13, further comprising six levers corresponding and attached to said six dampers.

16. The guitar of claim 15, wherein said six levers are staggered out of alignment with each other when all of said six dampers are in said closed position.

17. The guitar of claim 13, wherein said six strings are disposed offset out of coplanar alignment to themselves.

18. The guitar of claim 13, wherein said six dampers includes a first damper and a second damper, and said six strings includes a first string and a second string, wherein said first damper applies a first dampening force against said first string that is appreciably greater than a second dampening force applied by said second damper against said second string when said first damper and said second damper are in said closed position.

19. A guitar, comprising:

a body;

a headstock;

a nut attached to said headstock;

six tuning pegs attached to said headstock;

a neck with one end attached to said body and an opposite end attached to said headstock;

a plurality of frets on said neck for dividing said neck into a plurality of finger positions with a first finger position being adjacent a first fret and disposed on said headstock;

six strings attached to said body, extending along said neck, over and spaced apart from said plurality of frets, across said nut, and attached to said six tuning pegs, said six strings including a first string and a second string;

a damper device having a base coupled to said headstock; and six dampers corresponding to said six strings, said six dampers being pivotally connected to said base about a pivot point situated between said first fret and said tuning pegs, each of said six dampers being independently repositionable between a closed position and an open position, said six dampers include a first damper and a second damper, said closed position of said first damper representing said first damper engaging said first string at a location over said first finger position and exerting a first dampening force against said first string that is light enough to keep said first string spaced apart from said first fret yet larger than a second dampening force applied by said second damper against said second string when said second damper is in said closed position, said open position of said first damper representing said first damper disengaged from said first string.

* * * * *